US009066594B1

(12) United States Patent
Smith

(10) Patent No.: US 9,066,594 B1
(45) Date of Patent: Jun. 30, 2015

(54) METHOD OF IMPROVING SEAT COMFORT, SEAT, AND CUSHION SET ACCORDING TO THE SAME

(71) Applicant: Willem Smith & Company, LLC, Fairfax, VA (US)

(72) Inventor: John W. Smith, Great Falls, VA (US)

(73) Assignee: Willem Smith & Company, LLC, Fairfax, VA (US)

( * ) Notice: Subject to any disclaimer, the term of this patent is extended or adjusted under 35 U.S.C. 154(b) by 0 days.

(21) Appl. No.: 14/587,943

(22) Filed: Dec. 31, 2014

(51) Int. Cl.

| | |
|---|---|
| ***A47C 7/42*** | (2006.01) |
| ***A47C 7/02*** | (2006.01) |
| ***A47C 3/00*** | (2006.01) |
| ***A47C 31/02*** | (2006.01) |

(52) U.S. Cl.
CPC . *A47C 7/021* (2013.01); *A47C 3/00* (2013.01); *A47C 7/42* (2013.01); *A47C 31/023* (2013.01)

(58) Field of Classification Search
CPC ..... A47C 7/42; A47C 4/028; A47C 7/425
See application file for complete search history.

(56) References Cited

U.S. PATENT DOCUMENTS

| | | | | |
|---|---|---|---|---|
| 428,819 | A | | 5/1890 | Stace |
| 2,734,556 | A | | 2/1956 | Hebrank |
| 2,765,480 | A | | 10/1956 | Mueller |
| 3,019,051 | A | | 1/1962 | Nugent |
| 3,279,849 | A | | 10/1966 | Radke et al. |
| 3,602,548 | A | | 8/1971 | Grams |
| 3,747,977 | A | | 7/1973 | Rowland |
| 4,036,524 | A | | 7/1977 | Takamatsu |
| 4,159,146 | A | | 6/1979 | Braconnier et al. |
| 4,179,158 | A | | 12/1979 | Flaum et al. |
| 4,190,918 | A | | 3/1980 | Harvell |
| D258,482 | S | | 3/1981 | Strock |
| 4,365,840 | A | | 12/1982 | Kehl et al. |
| 4,506,396 | A | | 3/1985 | Ritchie, Jr. et al. |
| 4,864,668 | A | | 9/1989 | Crisp |
| 4,925,241 | A | | 5/1990 | Geraci |
| 5,029,928 | A | | 7/1991 | Huber |
| 5,161,854 | A | | 11/1992 | Yokoto et al. |
| 5,297,848 | A | | 3/1994 | Grinnell |
| 5,456,519 | A | | 10/1995 | Davis |
| 5,678,897 | A | * | 10/1997 | Prestia ..... 297/440.15 |
| 5,702,153 | A | * | 12/1997 | Pliska ..... 297/256.16 |
| 6,929,325 | B1 | | 8/2005 | Goelo |
| 8,458,873 | B2 | | 6/2013 | McConnell et al. |
| 8,534,755 | B2 | | 9/2013 | Nickerson |
| 2010/0270844 | A1 | | 10/2010 | Hood |

FOREIGN PATENT DOCUMENTS

| | | |
|---|---|---|
| GB | 1033154 | 6/1966 |

* cited by examiner

*Primary Examiner* — David R Dunn
*Assistant Examiner* — Timothy J Brindley
(74) *Attorney, Agent, or Firm* — Womble Carlyle Sandridge & Rice, LLP

(57) ABSTRACT

The present disclosure includes a loose-cushion seat with improved lower-back support. At least one connector is applied to a loose-cushion seating unit that joins a portion of the peripheral surface of the seat cushion to a portion of the rear surface of the back cushion. The connector is removably attached to at least one of the seat cushion and the back cushion so the cushions can be detached from one another. The connector joins the cushions in such a manner that at least a portion the back cushion is pulled down to remain in close proximity with the top surface of the seat cushion when the seat cushion is depressed under the weight of a user, thereby providing improved lower-back support to the user.

11 Claims, 5 Drawing Sheets

METHOD OF IMPROVING SEAT COMFORT, SEAT, AND CUSHION SET ACCORDING TO THE SAME

FIELD OF INVENTION

The present disclosure relates to improvements to seating units with loose cushions. The present invention also relates to a method of improving the support and comfort provided by seating units with loose cushions.

BACKGROUND

Certain cushioned chairs and sofas may be generally classified as loose-cushion seating. These cushioned chairs are generally considered as upholstered chairs. The upholstered chairs may only have upholstered cushions, or the entire seat may be upholstered.

Other cushioned chairs and sofas may be classified as tight seat, tight back or tight seat and back. In such a configuration, an upholstered seat is manufactured so that the seat cushion, the cushion on which the user sits, and/or the back cushion, the cushion provided behind a user's back, are attached, sewn onto or integrated in a fixed manner to the chair. The cushions of such a configuration are generally not removable.

In contrast, seats having a loose-back or loose-cushion design incorporate one or more seat cushions that can be shifted relative to, and removed from, the seating unit. These type seats also have one or more back cushions that can be shifted relative to, and removed from, the seating unit.

Many consumers prefer the "sit" comfort of loose-back seating units as compared to tight-back seats. However, the inventor has identified that loose-back seating units can provide insufficient lower-back support and can provide less than the optimal seating comfort, particularly after the user has been seated for an extended period of time.

Presently, users can, in some instances, somewhat address the problem of discomfort by readjusting the cushions upon which they may be sitting. Therefore, there is a need for a loose-cushion seating unit that does not require the user to readjust the cushions to remain comfortable over the duration of each use.

The sub-optimal lower-back support provided by some loose-back seats is at least partially caused by the phenomenon identified by the inventor and illustrated in FIG. 1. A conventional loose-back seat 100 is shown in FIG. 1. The seat 100 includes a frame 102, a seat cushion 104, and a back cushion 106. The cushions are not connected to the frame and are not connected to one another. When the user sits upon the seat 100, the force of their weight, illustrated by the arrow 108, presses down upon the seat cushion 104 and compresses the suspension mechanism, if present, in the seat frame. Friction between the back cushion 106 and the frame 102, or other forces, maintains the height of the back cushion 106 against the frame 102, resulting in a gap 110. The gap creates an area where the cushions are unable to support the user and sub-optimal comfort can result. Therefore there is a need for a way to reduce the gap between the cushions, without compromising the superior comfort benefits of a loose-back seating arrangement.

SUMMARY

The present disclosure includes a seat with improved lower-back support. The seat may include a frame with a seat portion and a back portion. A seat cushion may be positioned on the seat portion without being fixedly connected to the frame. The seat cushion preferably includes a top surface, a bottom surface, and a peripheral surface extending between, and around, the top surface and the bottom surface. The seat may also include a back cushion positioned adjacent to the back portion of the frame without being fixedly connected to the frame. The back cushion has a front surface, a rear surface, and a peripheral surface extending between, and around, the front surface and the rear surface. At least one connector joins a portion of the peripheral surface of the seat cushion to a portion of the rear surface of the back cushion. The connector is removably attached to at least one of the seat cushion and the back cushion so the cushions can be detached from one another. The connector joins the cushions in such a manner that at least a portion the back cushion is pulled down to remain in close proximity with the top surface of the seat cushion when the seat cushion is depressed under the weight of a user, thereby providing improved, more complete, lower-back support to the user.

The present disclosure also includes a cushion set. The cushion set may include a first cushion having a top surface, a bottom surface, and a peripheral surface extending between and around the top surface and the bottom surface. The set also includes a second cushion. The second cushion has a front surface, a rear surface, and a peripheral surface extending between and around the front surface and the rear surface. The second cushion is disposed generally upright and above the top surface of the first cushion. At least one connector joins a portion of the peripheral surface of the first cushion to the rear surface of the second cushion. The connector is removably attached to at least one of the first cushion and the second cushion. The connector joins the cushions such that at least a portion the second cushion is pulled down to remain in close proximity with the top surface of the first cushion when the first cushion is depressed under the weight of a user, thereby providing improved lower-back support to the user.

The present disclosure also provides a method of improving seat comfort of a loose-cushion seat. The seat includes a frame, the frame having a seat portion and a back portion, the seat also having a seat cushion positioned on the seat portion without being fixedly connected thereto. The seat cushion has a top surface, a bottom surface, and a peripheral surface extending between and around the top surface and the bottom surface. The seat also has a back cushion adjacent to the back portion without being fixedly connected thereto, the back cushion having a front surface, a rear surface, and a peripheral surface extending between and around the front surface and the rear surface. Comfort may be improved by providing a substantially non-elastic fabric connector and connecting a first end of the fabric connector to a portion of the peripheral wall of the seat cushion. The method further includes connecting a second, opposite end of the fabric connector to the rear surface of the back cushion. At least one of the ends is removably connected. When the connector is connected at the first end and the second end, a portion of the peripheral surface of the back cushion is disposed in close proximity to the top surface of the seat cushion. When attached, the connector is configured such that at least a portion of the back cushion is pulled down to remain in close proximity with the top surface of the seat cushion when the seat cushion is depressed under the weight of a user, thereby providing improved lower-back support to the user.

These and other aspects of the present invention will become apparent to those skilled in the art after a reading of the following description of the preferred embodiments, when considered in conjunction with the drawings. It should be understood that both the foregoing general description and the following detailed description are explanatory only and are not restrictive of the invention as claimed.

DETAILED DESCRIPTION

Exemplary embodiments of this disclosure are described below and illustrated in the accompanying figures, in which like numerals refer to like parts throughout the several views. The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. Features from one embodiment or aspect may be combined with features from any other embodiment or aspect in any appropriate combination. For example, any individual or collective features of method aspects or embodiments may be applied to apparatus, product or component aspects or embodiments and vice versa.

Figure 2:
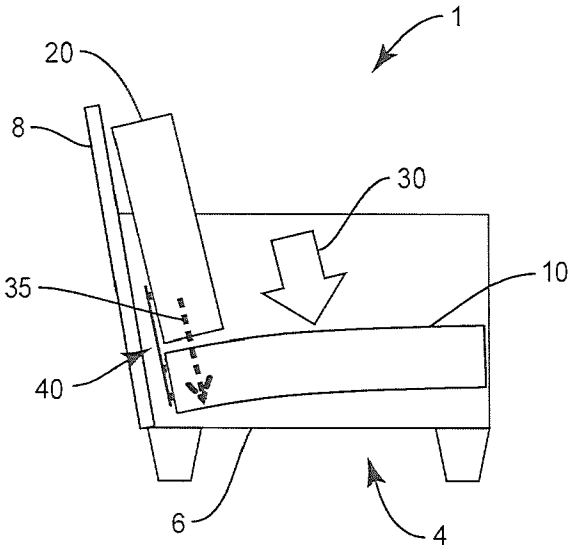
FIG. 2 shows a side view of a loose-cushion seating unit according to a first embodiment of the present disclosure, with one arm not shown.

FIG. 2 shows a side view of a seat 1 according to embodiments of the present disclosure. As used herein, the term seat may be used interchangeably with the term seating unit. As used herein the term seat includes, but is not limited to, couches, sofas, loveseats or chairs that may be intended to accommodate one person or a plurality of people. In preferred embodiments, the seat is fully upholstered with fabric. However, in other embodiments the seat may be partially upholstered in fabric or may be upholstered using other materials such as leather or vinyl.

Seats 1 according to the present disclosure include a frame 4 that generally includes a seat portion 6 to support a person in a seated position, and a back portion 8 generally considered to help support a user's back when they are in a seated position. The frame 4 may be upholstered in whole, in part, or not at all. The frame 4 may take any number of forms known in the art so long as the frame 4 is capable of supporting a seat cushion 10 and a back cushion 20. The frame 4 may include a suspension mechanism, such as springs or resilient straps, which are provided as part of the seat portion 6 and are able to deform under the weight of a user to enhance the comfort of the seat 1.

According to embodiments of the present disclosure, the seat 1 may include a connector 40. The connector 40 is specifically configured to attach the seat cushion 10 to the back cushion 20. The connector 40 attempts to improve the comfort of the seat 1 over an extended period of sitting, by improving the lower back support provided by the seat 1. Specifically, the connector 40 is configured to maintain the seat cushion 10 in close proximity to the back cushion 20 at all times, therefore minimizing or eliminating the gap 110 found in the prior art, and providing more complete support. As seen in FIG. 2, when a force 30 is applied to the seat cushion 10 in the presence of a user sitting upon the seat cushion 10, the back cushion 20 is pulled down in the direction along arrow 35 by the connector 40.

In some cases, the force 30 applied to the seat cushion 10 is not present at all points along the width of the seat cushion 10. As a result, portions of the seat cushion 10 may deform or be otherwise depressed downwardly by varied magnitudes. In one example, where the force 30 is applied near the center of the seat cushion 10 along the width direction, the seat cushion 10 may take a concave shape with a deep displacement near the center and minimal or no downward displacement near the edges.

Figure 1:
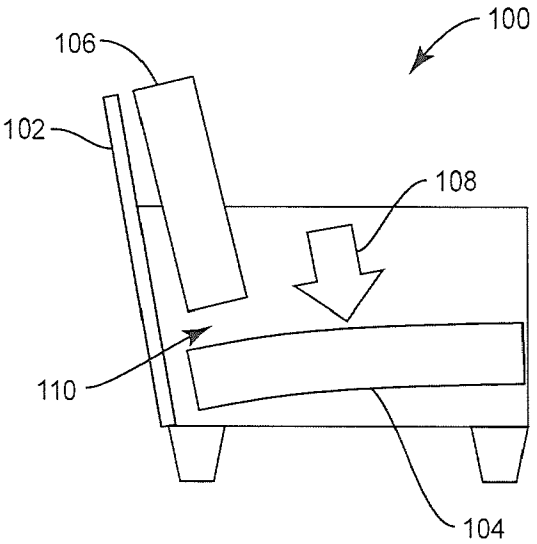
FIG. 1 PRIOR ART
FIG. 1 shows a side view of a loose-cushion seating unit according to the prior art, with one arm not shown.

Without the connector 40, a gap 110 is likely to form between the seat cushion 10 and the back cushion 20 as seen in the prior art FIG. 1. Friction between the frame's back portion 8 and the back cushion 106, friction between the back cushion and any adjacent back cushions, as well as support from potential edge portions of the seat cushion 104 that are not displaced, may all contribute to the formation of the gap 110 by resisting gravity and preventing the back cushion 106 from simply falling into place on top of the downwardly displaced seat cushion 104.

However, with the connector 40 joining the seat cushion 10 with the back cushion 20, when the seat cushion 10 is depressed, the back cushion 20 is pulled down by substantially the same distance, maintaining the close proximity of the two cushions, including, where necessary, producing a convex shape along the bottom of the back cushion 20 to match the concave depression at the top rear portion of the seat cushion 10.

Figure 3:
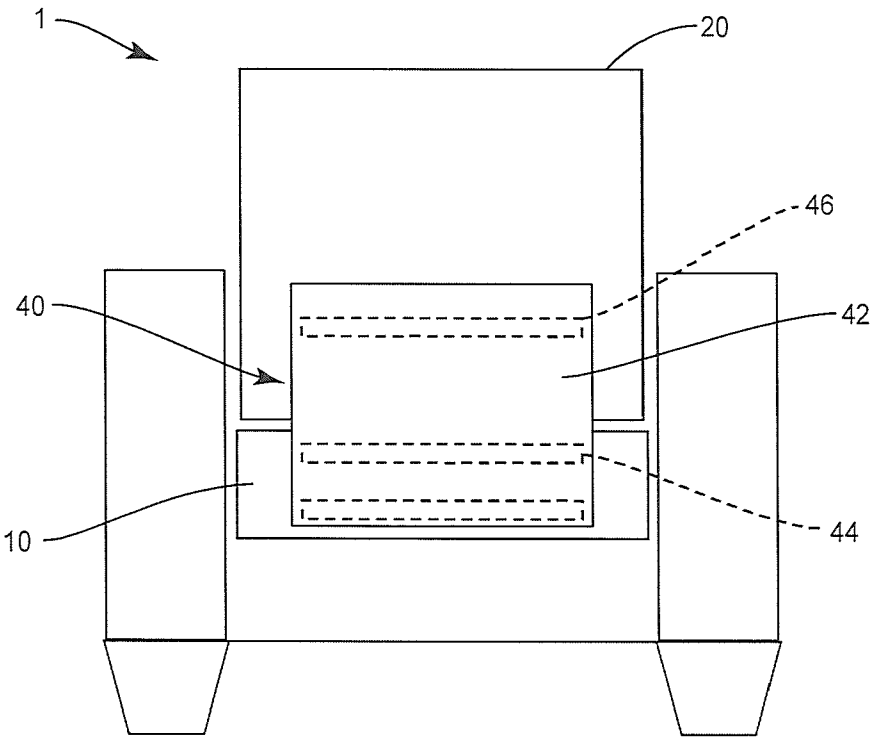
FIG. 3 shows a rear view of the seating unit according to FIG. 2 with the back frame portion not shown.

FIG. 3 shows a first embodiment of the connector 40 as seen through the rear side of the seat 1. The connector 40 may include a flap 42 that is removably attached to the seat cushion 10 and the back cushion 20. A first removable connection 44 is provided between the flap 42 and seat cushion 10. A second removable connection 46 is shown between the flap 42 and the back cushion 20. A removable connection is one that is intended to allow repeated connection, disconnection, and reconnection, without damage to the fastener or other mechanism creating the removable connection. Examples of removable connections are created by, but are not limited to, hook and loop fasteners as well as snap fasteners. Providing at least one removable connection 44, 46 allows the flap 42 to be adjusted relative to the cushions for a proper fit between the cushions.

In contrast to removable connections, two items are fixedly connected if the joint between the items is not intended to be connected, disconnect and reconnected, without damage to the joining element. Examples of fixedly connected elements include elements that are sewn, nailed, riveted or glued together.

In FIG. 3, the first removable connection 44 can represent a hook and loop type connection. The seat cushion 10 may be provided with one or more strips of a hook material or a loop material sewn or adhered thereto. The flap 42 may be provided with one or more strips of the opposite hook or loop material. In other embodiments, the flap 42 itself comprises a broad sheet of hook or loop material. Similarly, the second removably connection 46 can represent another hook and loop type connection.

In order to maintain the close proximity of the cushions 10, 20 the distance between the first removable connection 44 and the second removable connection 46 should remain substantially constant at all points across the width of the cushions when a depression force 30 is applied to the seat cushion 10.

To provide this maintenance of separation between connections, the flap 42 should be a substantially non-elastic material, such as a non-elastic fabric. The flap 42 also may be a material that is sufficiently stiff to limit creasing or folding. The non-elastic property can allow the flap 42 to pull down on the back cushion 20, when a user sits down, without elongating the flap 42. The stiffness property of the flap's material may assist with returning the back cushion 20 to its original position after the user has gotten up from the seat 1. The flap 42 may be constructed from the same fabric as used to upholster the seat 1, or cushions 10, 20, if the selected fabric is sufficiently non-elastic or has sufficient stiffness.

Figure 4:
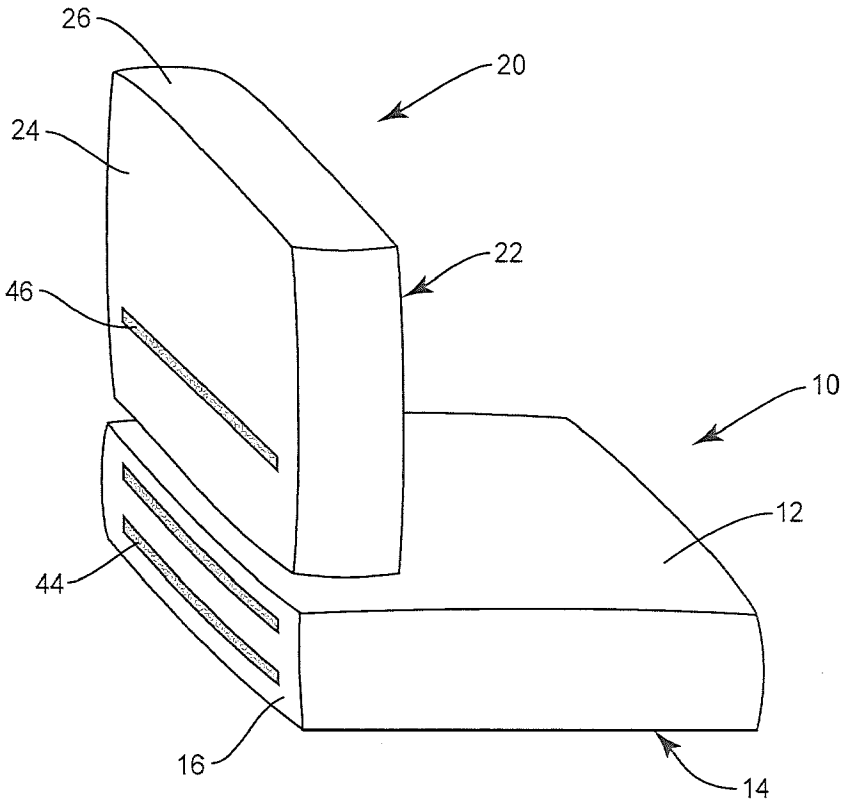
FIG. 4 shows cushions according to the first embodiment configured for use with the present seating unit.

FIG. 4 shows a perspective view of the seat cushion 10 and the back cushion 20 without the frame 4 or the flap 42 shown, to help identify the surfaces of each cushion. The seat cushion 10 may be defined as having a top surface 12, a bottom surface 14 and a peripheral surface 16. The peripheral surface 16 extends between the top and bottom surfaces and around the periphery of the seat cushion 10. The peripheral surface may be considered as having several sub-surfaces. In many cases, one of the sub-surfaces of the peripheral surface 16 of a seat cushion 10 may include a zipper to allow removal of a cover from a core. The zippered sub-surface would be a preferred sub-surface for the first removable connection 44. One of the advantages of loose cushions is that they can be routinely flipped to maintain an even wear pattern and shape, or they can be flipped on demand to hide stains or other blemishes. Therefore the terms top and bottom are relative. It should be understood that in preferred embodiments, the seat cushion 10 should maintain the ability to have either the top surface 12 or the bottom surface 14 facing upward.

Similarly, the back cushion 20 may be described as having a front surface 22, a rear surface 44, and a peripheral surface 26 that extends between the front surface and the rear surface, as well as extending around the periphery of the back cushion 20. While back cushions 20 also may be reversible in many loose-cushion seats of the prior art, most embodiments of the present disclosure fix the orientation of the back cushion 20 so that the rear surface 24 faces a rearward direction and the front surface 22 is the surface in contact with the user. The rear cushion 20 is generally not reversible in embodiments of the present disclosure because, while the removable second connection 46 provides for the ability to separate the flap 42 from the cushion 20, the removable second connection may include a portion of a fastener to be fixedly attached to the rear surface 24. For example, the rear surface 24 may include strips of a respective hook and loop fastener sewn thereto. In other embodiments, a portion of a snap fastener may be substantially permanently affixed to the rear surface 24. These fastening elements would likely be undesirable in a forward facing, visible orientation.

The inventor has determined that it is preferable to use the connector 40 to join the rear surface 24 to the seat cushion's peripheral surface 16. This arrangement, though not absolutely necessary, is preferred in order to allow the seat cushion 10 to maintain its reversibility. Attachment of the flap to the top or bottom surfaces 12, 14 would eliminate the ability to reverse the seat cushion 10. In some embodiments, the ability to reverse the seat cushion 10 may not be relevant, such as a one-sided leather cushion. In those embodiments, attachment of the connector 40 to the bottom surface 14 of the seat cushion 10 is more likely.

While attachment of the flap 42 to the back cushion's peripheral surface 26 may provide reversibility of the back cushion 20, the inventor has determined that matching the displacement of the back cushion 20 with the seat cushion 10 can be more effectively done when the flap 42 is attached to the rear surface 24. Additionally, joining the rear surface 24 to the seat cushion's peripheral surface 16 provides the desired direction of forces acting on the back cushion 20, maintaining a preferred angular arrangement between the cushions. Attachment of the flap 42 to the peripheral surface 26 of the back cushion has been show to potentially pull the back cushion 20 out of the desired angular arrangement.

Figure 5:
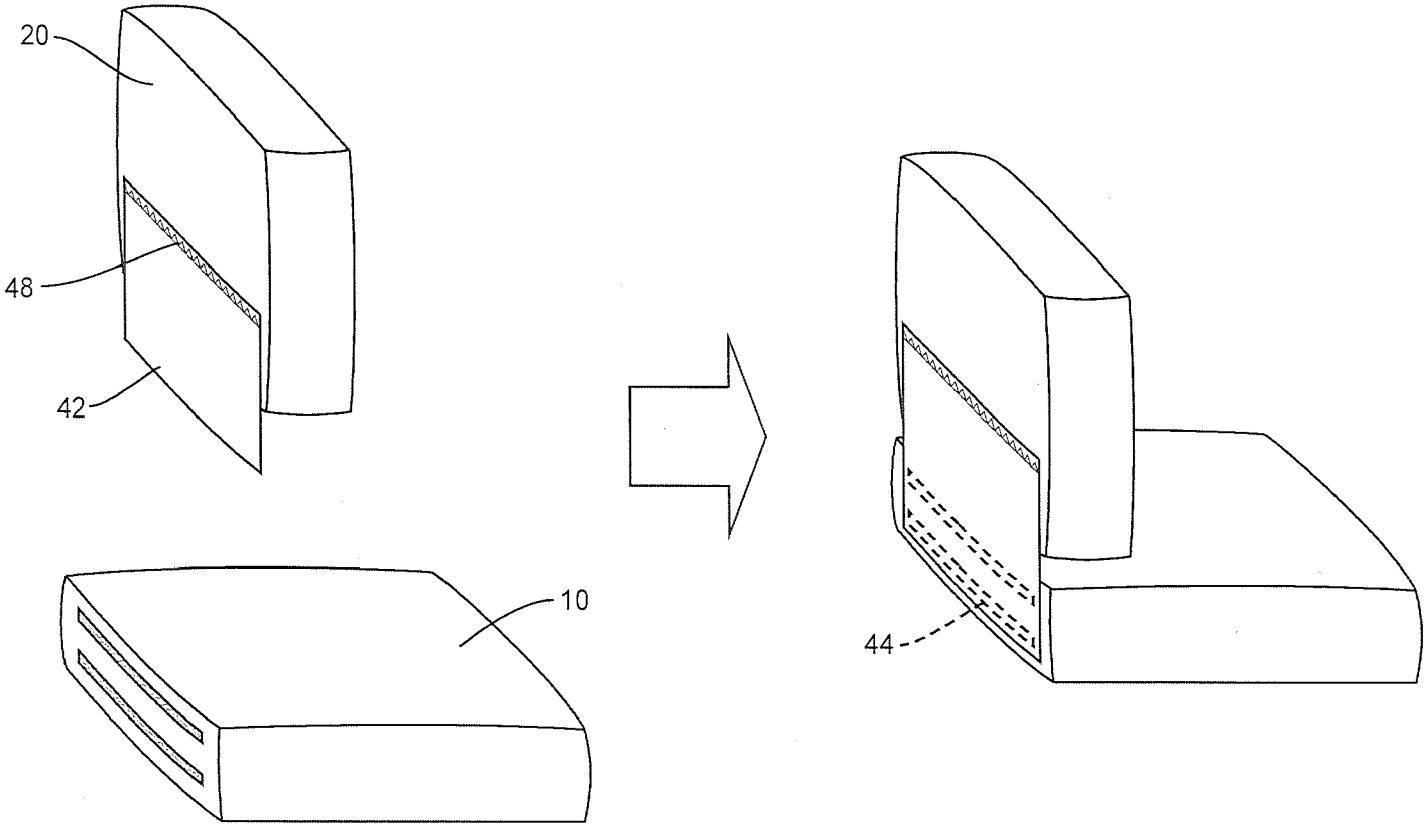
FIG. 5 shows cushion set for use in a seat according to a second embodiment of the present disclosure.

FIG. 5 shows a second embodiment for joining together the seat cushion 10 and the back cushion 20. The joined cushions provide a cushion set separate and apart from the seat 1, but fully usable with the frame 4 to create the seat 1. FIG. 5 shows the second embodiment in both an initial unattached position and an attached position. Unlike the first embodiment in FIGS. 3 and 4, where the flap 42 is removably attached to each cushion, in FIG. 5, the flap 42 has a fixed back connection 48 between the flap 42 and the back surface 24 of the back cushion 20. The fixed back connection 48 may be a sewn seam attaching the flap 42 to the back surface 24. In some embodiments, the flap 42 is attached to the exterior of the back surface 24. In other embodiments, the flap 42 may be attached to the interior side of the back surface 24. A slot (not shown) may be provided adjacent to the edge between the back surface 24 and the peripheral surface 26 to allow the flap 42 to exit from the interior of the back cushion 20. To maintain the benefits of the removable connector 40, first removable connections 44 remain for attaching the flap 42 to the seat cushion 10.

Figure 6:
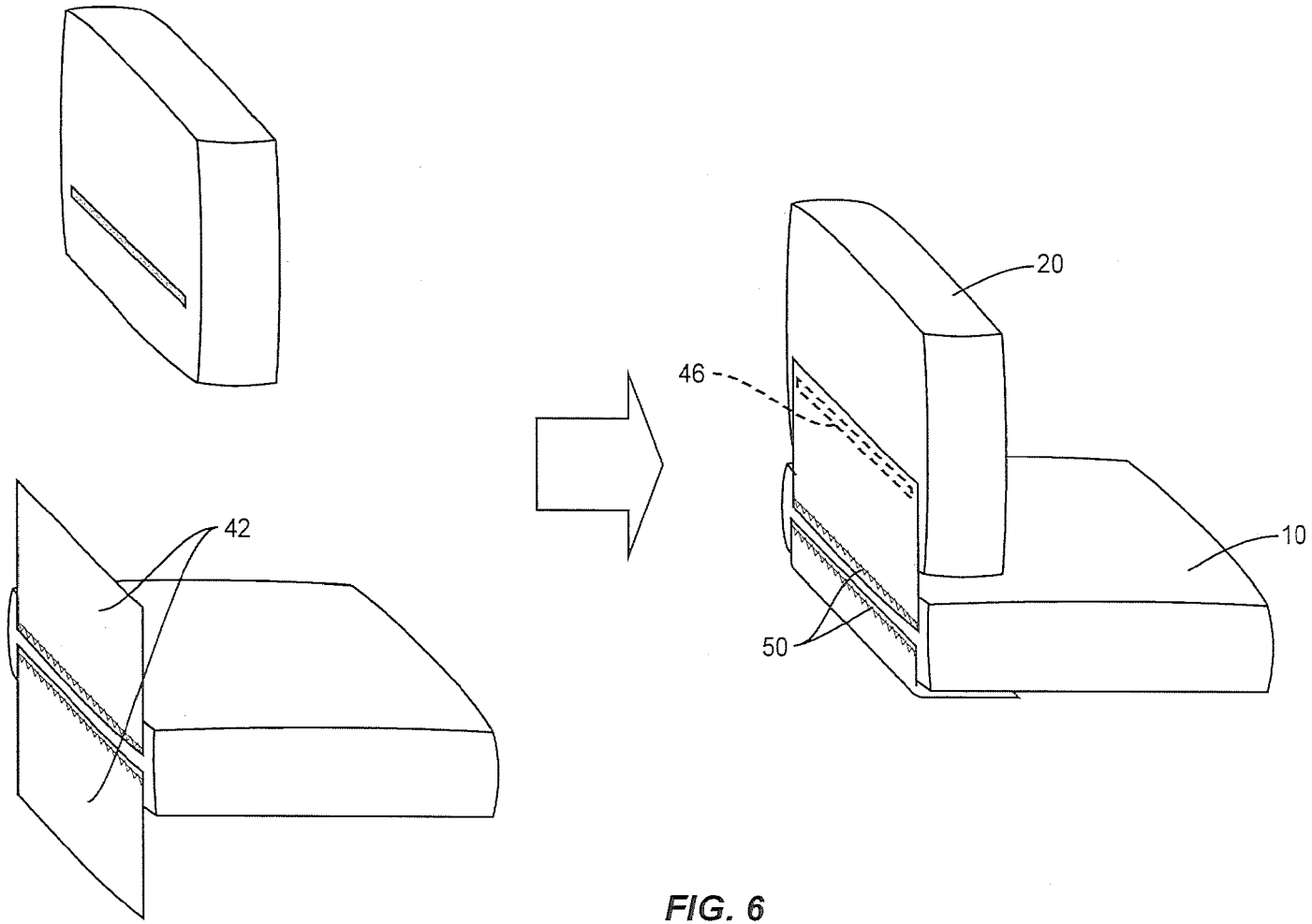
FIG. 6 shows a cushion set for use in a seat according to a third embodiment of the present disclosure.

FIG. 6 shows a third embodiment for joining together the seat cushion 10 and the back cushion 20. The joined cushions provide a cushion set separate and apart from the seat 1, but fully usable with the frame 4 to create the seat 1. FIG. 6 shows the third embodiment in both an initial unattached position and an attached position. In FIG. 6, the flap 42 has a fixed seat connection 50 between the flap 42 and the peripheral surface 16 of the seat cushion 10. The fixed seat connection 50 may be a sewn seam attaching the flap 42 to the peripheral surface 16. It is preferred that the fixed seat connection 50 is arranged so that the seat cushion's fabric can still be removed from the core for laundering, albeit with the flap 42 attached. In some embodiments, the flap 42 is attached to the exterior of the seat cushion 10. In other embodiments, the flap 42 may be attached to the interior. A pair of slots (not shown) may be provided adjacent to respective edges between the peripheral surface and each of the top and bottom surfaces. The slots allow the flap 42 to exit from the interior of the seat cushion 10. To maintain the benefits of the removable connector 40, the second removable connection 46 may be used for attaching the flap 42 to the back cushion 20.

Where a fixed seat connection 50 is used to attach the flap 42 to the seat cushion 10, it may be beneficial to include a pair of flaps 42 as seen in FIG. 6. Each of the flaps 42 can have a separate fixed-back connection 50. As can be understood from FIG. 6, where two flaps 42 are present, each flap may correspond to an orientation of the seat cushion 10. In other words, a single flap may be in use at any one time by connecting it with the back cushion 20. Then, when the user desires to flip over the seat cushion 10, the other flap 42 may be used for joining the cushions and the initial flap may be tucked away.

Use of the various embodiments of the connector 40 may be described in terms of a method of improving the comfort of a seating unit. The method also may be described as providing an improved level of support, particularly lower-back support, from a loose-cushion style seat. Each method can be based on improving, modifying or using a loose-cushion style seat, i.e. a seat that has a seat cushion separate and unattached from a frame and a back cushion separate and unattached from a frame.

An example method may include the steps of providing a substantially non-elastic fabric connector and then connecting each of: a first end of the fabric connector to a portion of the peripheral wall of the seat cushion, and a second, opposite end of the fabric connector to the rear surface of the back cushion. At least one of the ends is preferably removably connected. When the connector is connected at the first end and the second end, a portion of the peripheral surface of the back cushion is disposed in close proximity to the top surface of the seat cushion. The connector is configured such that at least a portion of the back cushion is pulled down to remain in close proximity with the top surface of the seat cushion when the seat cushion is depressed under the weight of a user, thereby providing improved lower-back support to the user.

Another example method may include, in a loose-cushion type seat, pulling the back cushion substantially vertically downward when the seat cushion is depressed under the weight of a user such that at least a portion of the back cushion remains in close proximity with a top surface of the seat cushion when the seat cushion is depressed, thereby providing improved lower-back support for the user.

In yet other embodiments, the connector 40 of the present disclosure may be provided as part of a kit to be used to retrofit an existing loose-cushion style seat. The kit may include the flap 42 and fastener portions to create the first and second removable connections 44, 46. The fastener portions may be strips of hook or loop fastening material, and the flap 42 may be a rectangular sheet of hook or loop fastening material. The flap is not limited to a rectangular shape. It may be preferred to have the sheet constructed from loop fabric and the strips constructed from hook fabric to minimize the area of hook fabric that can catch the upholstery fabric.

The flap may be at least 9 inches by 9 inches, but the size of the flap may vary based on the distance between the connection points provided on the seat and back cushions. In one embodiment, the second removable connection 46, or the fixed back connection 48, may be spaced above the bottom edge of the rear surface 24. The spaced arrangement may be particularly useful with a back cushion 20 having a pillowed shape resulting in convex curvature near the edges of each surface. By offsetting the connection 46, 48, the connection may be located at a relative flat portion of the rear surface 24, thereby helping to maintain the proper angle between the back cushion 20 and the seat cushion 10 during use. In other embodiments, where the back cushion 20 has minimal or no pillowing of the rear surface 24, it may be preferred to provide the second removable connection 46, or the fixed back connection 48, adjacent to the seam at the bottom edge of the rear surface 24.

In one example, consistent with FIG. 1, the kit may comprise the flap 42 and three pre-cut fastener strips, two strips to be fixed to the seat cushion's peripheral surface 16, and one strip to be fixed to the back cushion's rear surface 24. The strips may be provided with an adhesive layer to fix them to the cushions. In the preferred embodiments discussed above, the strips are sewn to the cushions. Therefore the retrofit kit could further comprise yarn for sewing or knitting the fastener portions to the cushions. Further, the retrofit kit may include instructions that would direct a reader how to apply the necessary components of the kit to the preexisting seat to produce the desired upgrades.

Although the above disclosure has been presented in the context of exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

I claim:

1. A seat with improved lower-back support, comprising:

a frame, the frame having a seat portion and a back portion;

a seat cushion positioned on the seat portion without being fixedly connected thereto, the seat cushion having a top surface, a bottom surface, and a peripheral surface extending between and around the top surface and the bottom surface;

a back cushion positioned adjacent to the back portion without being connected thereto, the back cushion having a front surface, a rear surface, and a peripheral surface extending between and around the front surface and the rear surface; and at least one connector joining a portion of the peripheral surface of the seat cushion to the rear surface of the back cushion, wherein the connector is removably attached to the seat cushion and the back cushion, wherein the connector joins the cushions such that at least a portion the back cushion is pulled down to remain in close proximity with the top surface of the seat cushion when the seat cushion is depressed under the weight of a user, thereby providing improved lower-back support to the user.

2. The seat according to claim 1, wherein the frame further comprises a suspension configured to depress under the weight of a seated user.

3. The seat according to claim 1, wherein the connector is removably attached to the back cushion with at least one fastener; and the connector is removably attached to the seat cushion with at least one fastener.

4. The seat according to claim 3, wherein the fasteners comprise at least one of a hook and a loop to provide a hook and loop fastener.

5. The seat according to claim 1, wherein the connector comprises a non-elastic material such that the distance between connection points of the connector to the cushions remains substantially constant when the seat cushion is depressed.

6. A cushion set comprising:

a first cushion comprising a top surface, a bottom surface, and a peripheral surface extending between and around the top surface and the bottom surface, wherein the first cushion is disposed generally horizontally;

a second cushion comprising a front surface, a rear surface, and a peripheral surface extending between and around the front surface and the rear surface, wherein the second cushion is disposed generally upright and above the top surface of the first cushion; and at least one connector joining a portion of the peripheral surface of the first cushion to the rear surface of the second cushion, wherein the connector is removably attached to the first cushion and the second cushion, wherein the connector joins the cushions such that at least a portion the second cushion is pulled down to remain in close proximity with the top surface of the first cushion when the first cushion is depressed under the weight of a user, thereby providing improved lower-back support to the user.

7. The cushion set according to claim 6, wherein the connector is removably attached to the second cushion with at least one fastener; and the connector is removably attached to the first cushion with at least one fastener.

8. The cushion set according to claim 7, wherein the fasteners comprise at least one of a hook and a loop to provide a hook and loop fastener.

9. The cushion set according to claim 8, wherein the connector comprises a non-elastic material such that the distance between connection points of the connector to the cushions remains substantially constant when the first cushion is depressed.

10. A method of improving seat comfort with a seat having a frame, the frame having a seat portion and a back portion, the seat also having a seat cushion positioned on the seat portion without being fixedly connected thereto, the seat cushion having a top surface, a bottom surface, and a peripheral surface extending between and around the top surface and the bottom surface; the seat also having a back cushion adjacent to the back portion without being connected thereto, the back cushion having a front surface, a rear surface, and a peripheral surface extending between and around the front surface and the rear surface, the method comprising:

providing a substantially non-elastic fabric connector;

connecting a first end of the fabric connector to a portion of the peripheral wall of the seat cushion; and connecting a second, opposite end of the fabric connector to the rear surface of the back cushion, wherein the first and second ends are removably connected, wherein, when the connector is connected at the first end and the second end, a portion of the peripheral surface of the back cushion is disposed in close proximity to the top surface of the seat cushion, wherein the connector is configured such that at least a portion of the back cushion is pulled down to remain in close proximity with the top surface of the seat cushion when the seat cushion is depressed under the weight of a user, thereby providing improved lower-back support to the user.

11. The method of claim 10, wherein:

connecting the first end comprises removably connecting the first end with at least a portion of a first fastener; and connecting the second end comprises removably connecting the second end with at least a portion of a second fastener.

* * * * *

UNITED STATES PATENT AND TRADEMARK OFFICE

CERTIFICATE OF CORRECTION

PATENT NO. : 9,066,594 B1
APPLICATION NO. : 14/587943
DATED : June 30, 2015
INVENTOR(S) : John W. Smith It is certified that error appears in the above-identified patent and that said Letters Patent is hereby corrected as shown below:

IN THE CLAIMS

In the text of claim 1, which begins at column 8, line 7, there is a typographical error in column 8 at line 25:

"a portion the back cushion" should read "a portion <u>of</u> the back cushion".

In the text of claim 6, which begins at column 8, line 45, there is a typographical error in column 8 at line 61:

"a portion the second cushion" should read "a portion <u>of</u> the second cushion".

Signed and Sealed this
First Day of December, 2015

Michelle K. Lee

Michelle K. Lee
*Director of the United States Patent and Trademark Office*